US011549285B2

(12) United States Patent
Stenhouse

(10) Patent No.: US 11,549,285 B2
(45) Date of Patent: Jan. 10, 2023

(54) LOCK ASSEMBLY

(71) Applicant: ASSA ABLOY NEW ZEALAND LIMITED, North Shore (NZ)

(72) Inventor: Damon Peter Stenhouse, Auckland (NZ)

(73) Assignee: ASSA ABLOY New Zealand Limited, North Shore City (NZ)

( * ) Notice: Subject to any disclaimer, the term of this patent is extended or adjusted under 35 U.S.C. 154(b) by 295 days.

(21) Appl. No.: 16/691,383

(22) Filed: Nov. 21, 2019

(65) Prior Publication Data

US 2020/0173198 A1 Jun. 4, 2020

(51) Int. Cl.

| | |
|---|---|
| ***E05B 65/08*** | (2006.01) |
| ***E05B 13/10*** | (2006.01) |
| ***E05B 15/04*** | (2006.01) |
| ***E05C 3/10*** | (2006.01) |
| ***E05B 1/00*** | (2006.01) |

(Continued)

(52) U.S. Cl.

CPC ..... *E05B 65/0858* (2013.01); *E05B 13/10* (2013.01); *E05B 9/08* (2013.01);

(Continued)

(58) Field of Classification Search

CPC .... E05B 65/0858; E05B 13/10; E05B 1/0053; E05B 65/0811; E05B 9/08; E05B 55/005;

(Continued)

(56) References Cited

U.S. PATENT DOCUMENTS 479,104 A * 7/1892 Fleischel et al. ... E05B 65/0811 70/99
2,224,671 A * 12/1940 Crooks ..... E05B 47/0002 70/151 R (Continued)

FOREIGN PATENT DOCUMENTS

CN 102465640 5/2012
CN 103132809 6/2013

(Continued)

OTHER PUBLICATIONS

Official Action with English Translation for China Patent Application No. 201911215143.3, dated Sep. 17, 2021, 13 pages.

*Primary Examiner* — Christine M Mills
*Assistant Examiner* — Faria F Ahmad
(74) *Attorney, Agent, or Firm* — Sheridan Ross P.C.

(57) ABSTRACT

A lock assembly comprising: a hand-operable member configured to move laterally relative to a fore-end of the lock assembly; wherein lateral movement of the hand-operable member causes the lock assembly to move between a locked mode and an unlocked mode. A lock assembly comprising: a latch, the latch configured to move rotationally relative to the lock assembly; and a hand-operable member configured to move laterally relative to a fore-end of the lock assembly; wherein the hand-operable member is coupled to the latch such that lateral movement of the hand-operable member drives rotational movement of the latch. Methods of installing a lock assembly, comprising setting a hub of a lock assembly to one of a first unlocked position, a first locked position, a second unlocked position, a second locked position, or a deadlocked position, and installing a cylinder lock for engagement with the hub.

18 Claims, 7 Drawing Sheets

(51) Int. Cl.

| | |
|---|---|
| ***E05B 55/00*** | (2006.01) |
| ***E05C 3/16*** | (2006.01) |
| ***E05C 3/00*** | (2006.01) |
| ***E05C 3/06*** | (2006.01) |
| ***E05C 3/30*** | (2006.01) |
| ***E05C 3/34*** | (2006.01) |
| ***E05B 9/08*** | (2006.01) |

(52) U.S. Cl.
CPC ..... *E05B 15/04* (2013.01); *E05B 55/005* (2013.01); *E05B 65/08* (2013.01); *E05B 65/0811* (2013.01); *E05C 3/004* (2013.01); *E05C 3/10* (2013.01); *E05C 3/167* (2013.01); *E05C 3/30* (2013.01); *E05C 3/34* (2013.01); *Y10S 292/46* (2013.01); *Y10T 292/081* (2015.04); *Y10T 292/0825* (2015.04); *Y10T 292/0829* (2015.04); *Y10T 292/57* (2015.04)

(58) Field of Classification Search
CPC ..... E05B 1/0038; E05B 1/0046; E05B 2001/0076; E05B 65/08; E05B 2065/0805; E05Y 2900/132; Y10T 292/081; Y10T 292/0825; Y10T 292/1043; Y10T 292/1075; Y10T 292/0848; Y10T 292/57; Y10T 292/0829; Y10T 292/0831; Y10T 292/0851; Y10T 292/0854; Y10T 292/0857; Y10S 292/46; E05C 3/00; E05C 3/004; E05C 3/02; E05C 3/06; E05C 3/10; E05C 3/16; E05C 3/165; E05C 3/167; E05C 3/30; E05C 3/34
See application file for complete search history.

(56) References Cited

U.S. PATENT DOCUMENTS 2,530,330 A * 11/1950 Groeger ..... E05B 65/0811 292/29
2,540,686 A * 2/1951 Milburn ..... E05B 65/0811 292/124
2,668,070 A * 2/1954 Schmitt ..... E05C 3/34 292/27
2,789,852 A * 4/1957 Eads ..... E05B 65/0817 292/110
3,175,376 A * 3/1965 Cantwell ..... E05B 63/127 70/131
3,899,201 A * 8/1975 Paioletti ..... E05B 65/0858 292/25
4,554,907 A * 11/1985 Overley ..... F24C 15/022 126/191
4,973,091 A * 11/1990 Paulson ..... E05C 9/041 292/51
5,390,516 A * 2/1995 Alchin ..... E05B 65/0835 292/129
5,526,659 A * 6/1996 Takimoto ..... E05B 65/0811 292/29
5,820,170 A * 10/1998 Clancy ..... E05B 65/0858 292/26
5,951,068 A * 9/1999 Strong ..... E05C 9/185 292/39
6,502,435 B2 * 1/2003 Watts ..... E05B 63/20 292/336.3
6,540,268 B2 * 4/2003 Pauser ..... A45C 13/06 220/243
6,672,632 B1 * 1/2004 Speed ..... E05B 65/0858 292/11
6,748,773 B2 * 6/2004 Alchin ..... E05B 65/0811 70/99
6,827,376 B2 * 12/2004 Fountaine ..... E05B 9/08 292/98
6,981,724 B2 * 1/2006 Denys ..... E05B 63/24 292/64
7,032,417 B2 * 4/2006 Toulis ..... E05B 65/0811
7,040,671 B2 * 5/2006 Su ..... E05B 63/0013 292/116
7,178,839 B2 * 2/2007 Tsai ..... E05B 65/0858 292/112
7,228,719 B2 * 6/2007 Alchin ..... E05B 65/0858 292/199
7,427,087 B2 * 9/2008 Chuang ..... E05C 3/06 292/98
7,559,584 B2 * 7/2009 Rebel ..... E05B 63/0056 292/25
7,604,265 B2 * 10/2009 Tsai ..... E05B 65/0858 292/116
7,665,775 B1 * 2/2010 Miller ..... E05B 65/0841 292/240
7,837,241 B2 * 11/2010 Chung ..... E05B 65/0811 292/199
7,905,521 B2 * 3/2011 Liang ..... E05B 65/0858 292/51
8,376,414 B2 * 2/2013 Nakanishi ..... E05B 65/0811 292/26
8,534,099 B2 * 9/2013 Wheeler ..... E05B 15/102 70/100
8,550,506 B2 * 10/2013 Nakanishi ..... E05B 17/2038 292/32
8,827,324 B2 * 9/2014 Furgiuele ..... E05B 63/20 292/137
8,931,812 B1 * 1/2015 Hauber ..... E05B 63/185 292/26
9,790,716 B2 * 10/2017 Hagemeyer ..... E05B 65/0858
10,323,438 B2 * 6/2019 Chang ..... E05B 63/18
11,111,698 B2 * 9/2021 Mitchell ..... E05C 7/06
2002/0047278 A1 * 4/2002 Pauser ..... E05B 65/5261 292/48
2002/0139154 A1 * 10/2002 Martinez ..... E05C 3/06 70/123
2002/0195824 A1 * 12/2002 Fountaine ..... E05B 65/0811 292/11
2002/0195826 A1 12/2002 Fountaine
2006/0007649 A1 * 1/2006 Yang ..... E05C 1/10 361/679.27
2006/0071478 A1 * 4/2006 Denys ..... E05C 9/10 292/26
2006/0076783 A1 * 4/2006 Tsai ..... E05B 65/0858 292/24
2008/0258475 A1 * 10/2008 Chung ..... E05B 65/0811 292/25
2008/0265587 A1 * 10/2008 Nakanishi ..... E05B 63/042 292/26
2009/0134634 A1 * 5/2009 Atkinson ..... E05B 65/0858 292/26
2010/0084875 A1 * 4/2010 Keighley ..... E05B 1/0038 292/152
2010/0263415 A1 * 10/2010 Ruspil ..... E05B 63/20 70/89
2012/0235424 A1 * 9/2012 Zhang ..... E05B 7/00 292/29
2013/0152647 A1 * 6/2013 Terei ..... E05B 57/00 70/357
2015/0252595 A1 * 9/2015 Hagemeyer ..... E05B 63/242 292/138
2017/0328088 A1 * 11/2017 Chantler ..... E05B 17/2088
2018/0155964 A1 * 6/2018 Chang ..... E05B 65/0811
2020/0332556 A1 * 10/2020 Gustavsson ..... E05C 9/043
2021/0071457 A1 * 3/2021 Seppanen ..... E05F 3/227

FOREIGN PATENT DOCUMENTS

KR 2002-0017890 3/2002
WO WO 2008/124067 10/2008

* cited by examiner

LOCK ASSEMBLY

CROSS-REFERENCE TO RELATED APPLICATIONS

This application claims the benefit of New Zealand Patent Application No. 748921 filed 3 Dec. 2018, the entire contents of which are incorporated herein by reference.

FIELD

This relates to a lock assembly for a sliding panel, such as a door or a window.

BACKGROUND

Sliding panels can have lock assemblies which allow the sliding panel to be selectively locked in place or slideable. For example, a sliding door or window may have a lock assembly in which a latch engages with a strike plate in the frame to lock the sliding door or window relative to the door frame or window frame.

Existing lock assemblies may not be entirely suitable for a particular intended arrangement.

SUMMARY

In a first example embodiment, there is provided a lock assembly comprising: a hand-operable member configured to move laterally relative to a fore-end of the lock assembly; wherein lateral movement of the hand-operable member causes the lock assembly to move between a locked mode and an unlocked mode.

In a second example embodiment, there is provided a lock assembly comprising: a latch, the latch configured to move rotationally relative to the lock assembly; and a hand-operable member configured to move laterally relative to a fore-end of the lock assembly; wherein the hand-operable member is coupled to the latch such that lateral movement of the hand-operable member drives rotational movement of the latch.

In a third example embodiment, there is provided a method of installing a lock assembly, the method comprising: setting a hub of a lock assembly to one of a first unlocked position, a first locked position, a second unlocked position, a second locked position; and installing a cylinder lock for engagement with the hub.

In a fourth example embodiment, there is provided a method of installing a lock assembly, the method comprising: setting a hub of a lock assembly to a deadlocked position; installing a cylinder lock for engagement with the hub; and rotating the cylinder lock towards one of a first locked position and a second locked position; wherein if the cylinder lock is rotated towards the first locked position, the cylinder lock cannot be rotated into the second locked position, and if the cylinder lock is rotated towards the second locked position, the cylinder lock cannot be rotated into the first locked position.

In a fifth example embodiment, there is provided a plug for a lock assembly, the lock assembly being movable between a locked mode and a deadlocked mode, wherein the plug is configured for engagement in the lock assembly to prevent the lock assembly moving from the locked mode into the deadlocked mode.

BRIEF DESCRIPTION OF DRAWINGS

The invention is described by way of example with reference to the drawings, which show some embodiments of the invention. These are provided for illustration only. The invention is not limited to the particular details of the drawings and the corresponding description.

DETAILED DESCRIPTION

Figure 1:
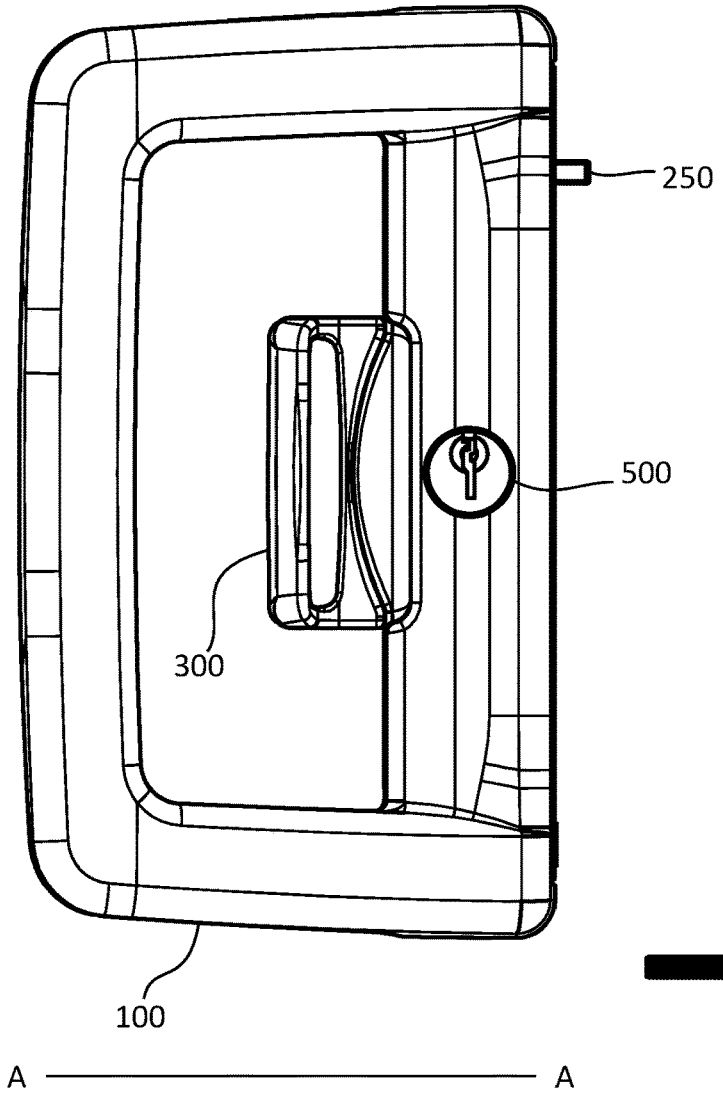
FIG. 1 shows a front view of a lock assembly according to one example embodiment.
Figure 2:
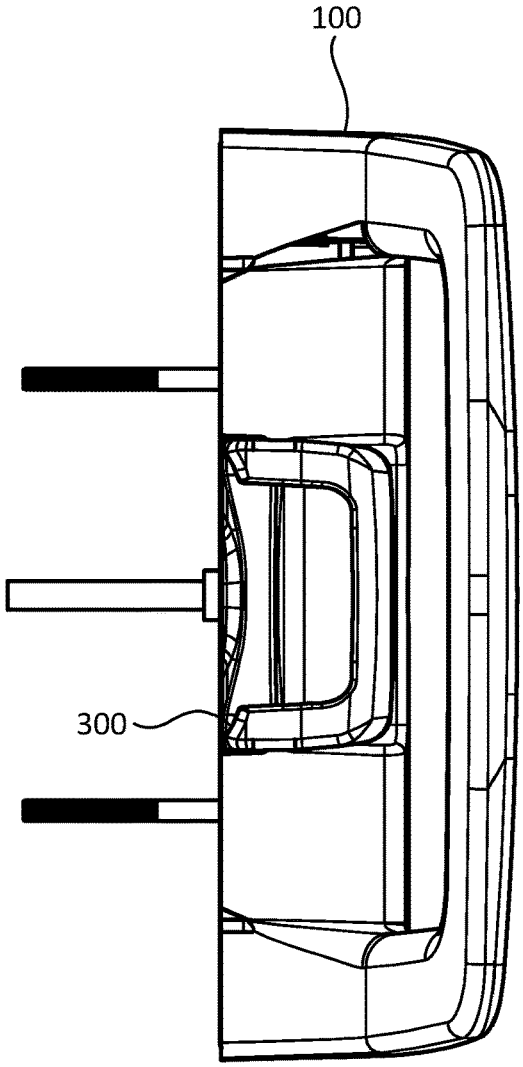
FIG. 2 shows a first side view of the lock assembly of FIG. 1.
Figure 3:
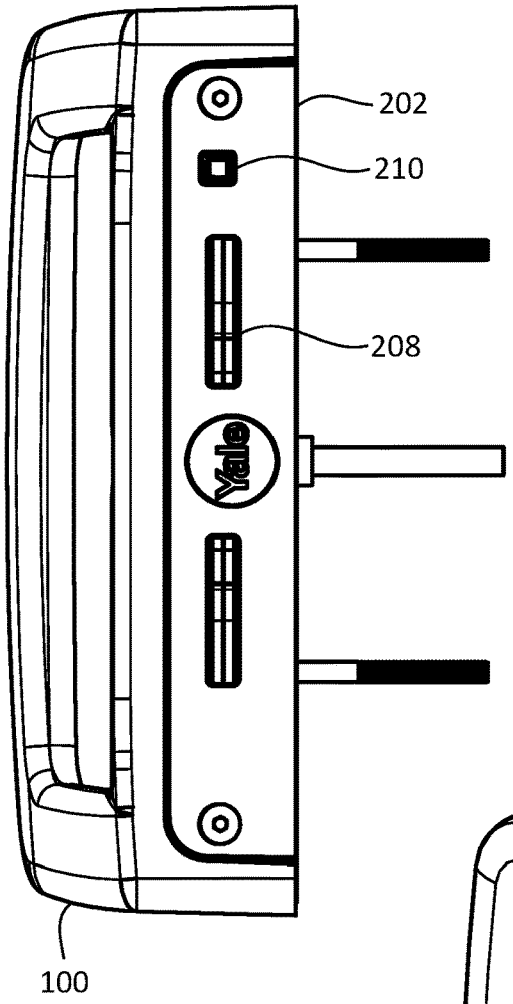
FIG. 3 shows a second side view of the lock assembly of FIG. 1.
Figure 4:
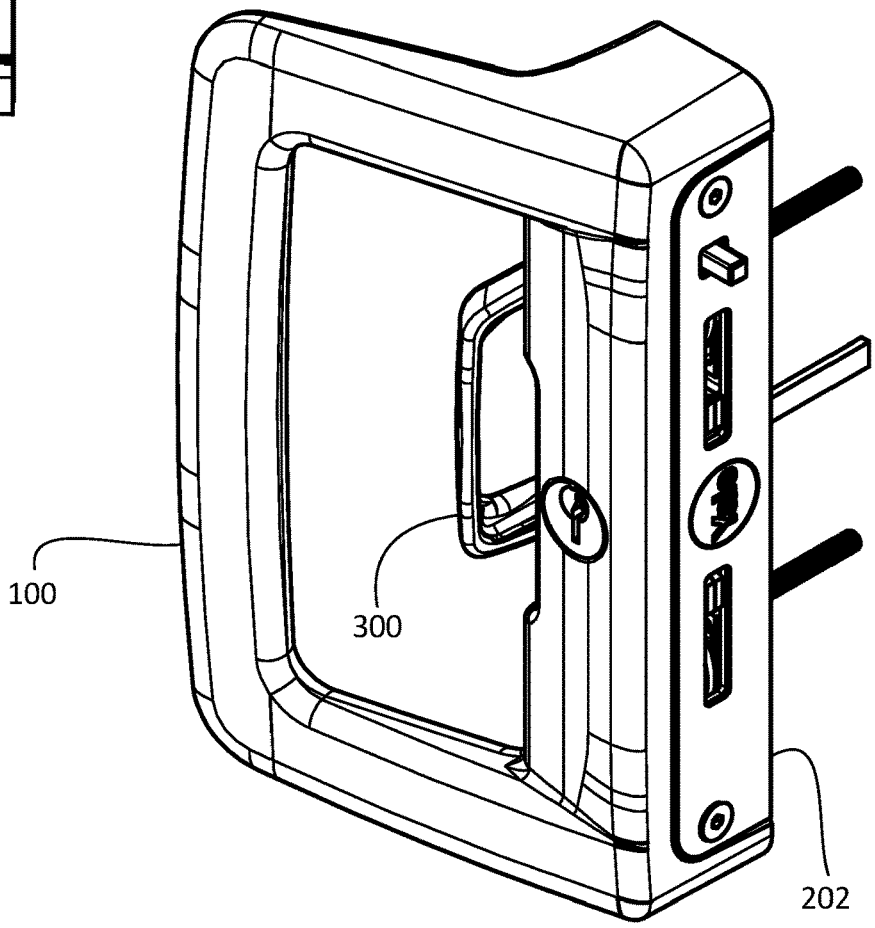
FIG. 4 shows an isometric view of the lock assembly of FIG. 1.

FIGS. 1 to 4 show a lock assembly in accordance with one example embodiment. The lock assembly is for a sliding panel, such as a door or a window, which slides relative to a frame, such as a door frame or window frame. The lock assembly may be mounted on the surface of the sliding panel.

The lock assembly has a handle 100 which can be used to open and close the sliding panel and a hand-operable member 300 to move the lock assembly between unlocked and locked modes. The hand-operable member 300 can be moved laterally along an axis A-A (that is, laterally relative to a fore-end of the lock assembly, such as the fore-end at fore-end plate 202). By a user pulling out or pushing in the hand-operable member 300, the lock assembly moves between an unlocked mode and a locked mode.

The lateral movement of the hand-operable member 300 may provide an easy way for a user to move the lock assembly between the unlocked mode and the locked mode. In addition, because a user can use the handle 100 as leverage to pull the hand-operable member 300, and because the hand-operable member 300 is large enough to be pulled by multiple fingers, the hand-operable member 300 can be operated even by users with diminished strength.

In a locked mode, a latch is engaged. This takes the form of two counter-rotating beaks 400 which rotate out of latch apertures 208 in a fore-end plate 202 of the lock assembly. The beaks 400 can engage with a strike plate in a frame to retain the sliding panel relative to the frame. In an unlocked mode, the latches have rotated back through the latch apertures 208 and into the body of the lock assembly. This allows the sliding panel to move relative to the frame.

The lock assembly may require that an anti-slam mechanism 350 is depressed before the latch can be engaged. This may occur when the sliding panel is engaged with the frame, to ensure that the beaks 400 engage with the strike plate.

The lock assembly has a cylinder lock 500. A user rotating the cylinder 502 of the cylinder lock 500 causes the lock assembly to move between the unlocked mode, the locked mode, and a deadlocked mode. The cylinder lock 500 can therefore be used as an alternative to the hand-operable member 300. For example, the cylinder lock 500 may be used on the outside of a door, while the hand-operable member 300 is used on the inside of a door.

Figure 5:
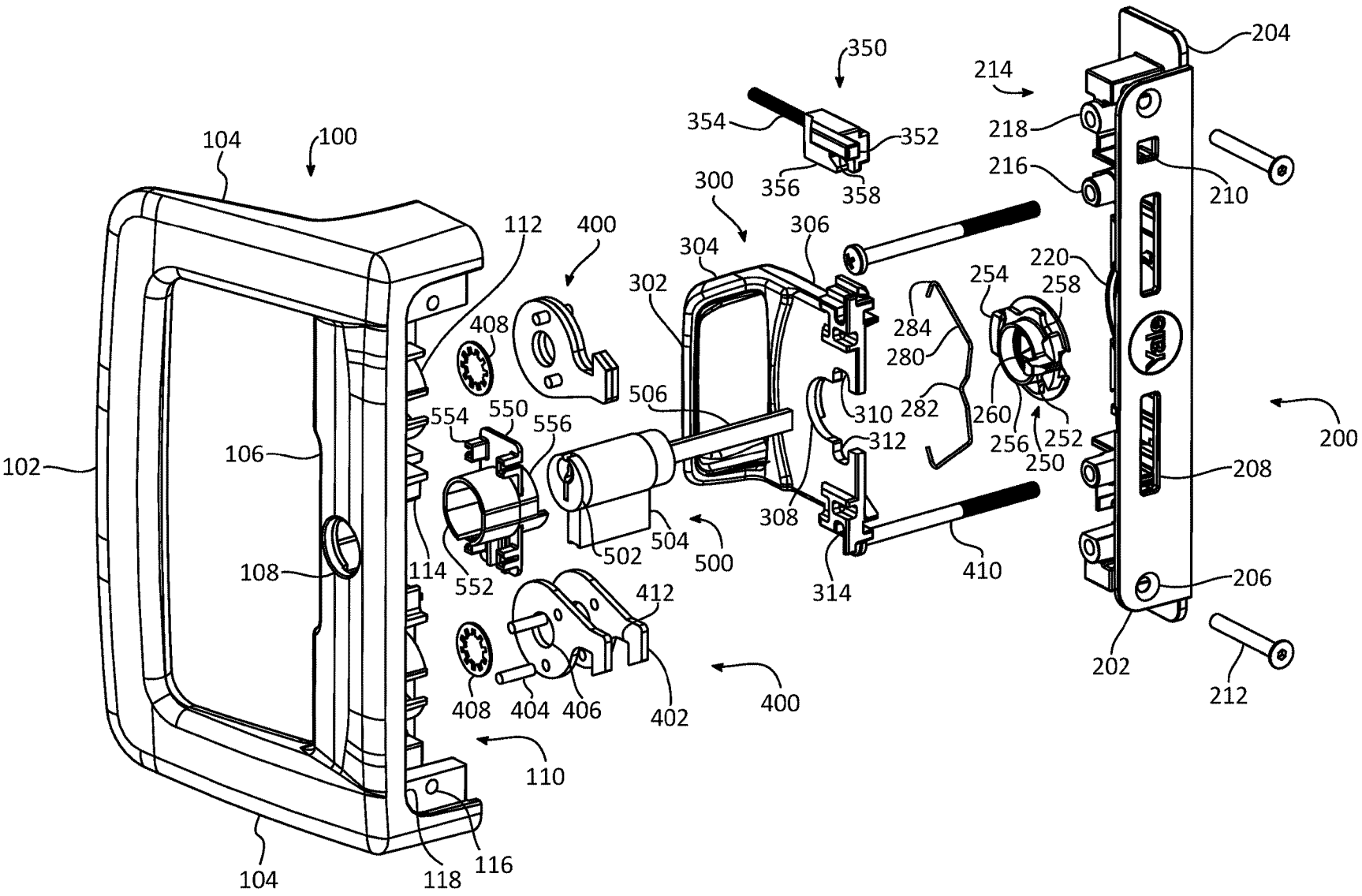
FIG. 5 shows an exploded view of the lock assembly of FIG. 1.

FIG. 5 shows an exploded view of the lock assembly of FIGS. 1 to 4.

The handle 100 comprises a handhold 102 connected to the body 106 by two arms 104 on either end of the handhold 102. The handhold 102 is shown as integrally formed with the arms 104 and body 106. However, in some cases, the handhold and arms 104 may be formed separately from the body 106, and may be connected to the body 106 with fasteners such as rivets or screws. The handle 100 may be formed of plastic or metal.

A cylinder lock aperture 108 is formed in the body 106. The cylinder lock aperture 108 may be sized to allow portion of a cylinder lock 500 to pass through without allowing the whole of the cylinder lock 500 to pass through.

The handle 100 defines an inner section 110. The inner section 110 has guides 112 for use with the beaks 400 and a retainer mounting 114 for a cylinder lock retainer 550.

A body mount 200 has a fore-end plate 202 and a base plate 204 which are connected at approximately a right angle. The fore-end plate 202 and the base plate 204 may be integral or may be connected together from separate parts, for example by welding.

The fore-end plate 202 defines two screw holes 206 at either end, two latch apertures 208 spaced apart, and an anti-slam button aperture 210 at one end.

Each screw hole 206 is configured to receive a fastener 212. The screw 212 can then pass into a respective screw hole 116 in the handle 100. Screws 212 can couple the handle 100 to the body mount 200. The fit may be such that the fore-end plate 202 sits flush in a recess 118 of the handle 100.

Each latch aperture 208 is sized and shaped to allow a portion of a beak 400 to pass through.

The anti-slam button aperture 210 is sized and shaped to allow a button 352 of an anti-slam mechanism 350 to pass through.

The body mount 200 defines an inner section 214, which may be complementary to the inner section 110 of the handle 100. A pair of screw holes 216 are provided at each end of the body mount 200. A further pair of screw holes 218 are provided at each end of the body mount 200. A fastener, such as a screw, can pass through each screw hole 216 and/or each screw hole 218 to mount the body mount 200 to the surface of a sliding panel. Each pair of screw holes 216 and 218 may be set at different spacing to allow for wider compatibility. For example, screw holes 216 may be about 125 mm apart and screw holes 218 may be about 82 mm apart.

When the handle 100 and the body mount 200 are coupled together, they form a housing for the lock assembly.

A hub mount 220 is provided in the inner section 214 for receiving a hub 250.

The hub 250 is generally circular, and comprises a cam 252 which protrudes from a face of the hub 250 at one point of the circumference of the hub 250. A locking protrusion 254 is provided opposite the cam 252. Between the cam 252 and the locking protrusion 254 is a channel 260 surrounded by a boss 256. The channel 260 can receive a tailpiece 506 of a cylinder lock 500. In some cases, the channel 260 is omitted, and the hub 250 is configured to couple to a cam of a cylinder lock (such as for cylinders having a cam rather than a tailbar).

A series of five indents 258 are provided around the circumference of the hub 250. The indents 258 are configured to receive a protrusion 282 of a bias member in the form of a spring 280. This acts as a detent such that the hub 250 is biased towards the positions corresponding to the indents 258.

The hand-operable member 300 comprises a fingerhold 302 connected to a body plate 306 by two arms 304. The fingerhold 302 is shown as integrally formed with the arms 304 and body plate 306. However, in some cases, the fingerhold 302 and arms 304 may be formed separately from the body plate 306, and may be connected to the body plate 306 with fasteners such as rivets or screws. The hand-operable member 300 may be formed of plastic or metal.

The space formed between the fingerhold 302, the arms 304, and the body plate 306 may be large enough to accommodate multiple fingers from an average user, such as at least two fingers.

A central indent 308 in the body plate 306 is formed to accommodate the boss 256 of the hub 250. Two cut-outs 310, 312 are formed from the central indent 308 to accommodate the cam 252 of the hub 250.

The hand-operable member 300 comprises a pair of pockets 314 at each end. Each pocket 314 is configured to receive a pin of a beak 400. This couples the beak 400 directly to the hand-operable member 300. This avoids the need for any intermediate piece to translate the linear movement of the hand-operable member 300 to rotational movement of the beak 400.

The hand-operable member 300 may have a detent 318 configured to interact with a respective protrusion 284 of the spring 280. This biases the hand-operable member 300 towards the locked or unlocked position. The same spring 280 is therefore used to bias the hub 250 and the hand-operable member 300, avoiding the need for multiple springs to be provided.

A block 316 protrudes from the back face of the body plate 306. The block 316 may be configured to abut the locking protrusion 254 of the hub 250 when the hub 250 is the deadlocked position. This allows the hub 250 to prevent the hand-operable member 300 from being extended.

An anti-slam mechanism 350 has a button 352 which can pass through the anti-slam button aperture 210 of the fore-end plate 202. A spring 354 biases the button 352 towards an extended position in which the button 352 extends through the anti-slam button aperture 210. In this extended position, a block 356 can be aligned with a pin 404 of a beak 400 to prevent the beak 400 rotating. When the button 352 is depressed, the pin 404 can be received in a recess 358 of the anti-slam mechanism 350. This can allow the beak 400 to rotate.

The beaks 400 each comprise two or more laminated layers 402. The layers 402 are coupled through two pins 404 passing through pin apertures in the layers 402. The layers 402 and pins 404 may be formed of a metal, such as steel or zinc, or a plastic material. A pin 404 of each beak 400 engages with the hand-operable member 300. This couples each beak 400 directly to the hand-operable member 300. This avoids the need for a separate piece to act as a coupling between the hand-operable member 300 and the beak 400.

On a side of each beak 400 facing the handle 100, the pins 404 may be located around guides 112. The guides 112 define a rotational path for the beaks 400.

A post 410 can pass through a central aperture 406 of each beak 400 to mount the beak 400 to the body mount 200. The post 410 forms a pivot point, so that the beak 400 can rotate relative to the body mount 200. A toothed washer 408 may be provided between the post 410 and the beak 400 to retain the beak 400 relative to the post 410.

Each beak defines a recess 412 which is configured to engage an edge of a strike plate of a sliding panel frame. When the lock assembly is in a locked mode, an edge of the strike plate is located within the recess 412. This prevents the sliding panel from moving away from the strike plate and consequently the frame.

A cylinder lock 500 has a cylinder 502 which rotates relative to a shell 504. Pins in the shell 504 normally sit partially within the cylinder 502. This prevents the cylinder 502 from rotating. When a suitable key is inserted, the pins are aligned such that the cylinder 502 can rotate.

A tailpiece 506 extends from the back of the cylinder lock 500. The tailpiece 506 is coupled to the cylinder 502 such that rotation of the cylinder 502 causes rotation of the tailpiece 506. The tailpiece 506 has a polygonal cross-section, such as rectangular.

In some cases, the cylinder lock 500 may have a cam which rotates about the outside of the cylinder lock 500 in concert with the cylinder 502.

The cylinder lock 500 can be inserted into a cylinder lock retainer 550. The cylinder lock retainer 550 has a mount 552 which receives a front portion of the cylinder lock 500. Clips 554 on the cylinder lock retainer 550 engage with the retainer mounting 114 via a friction fit.

A formation 556 on the rear of the cylinder lock retainer 550 may be configured to limit the rotation of the hub 250. The formation 556 may be a recess bounded by walls. The cam 252 of the hub 250 may move through the recess. At the ends of the recess, the cam 252 abuts the walls to limit further rotation of the hub 250. For example, the formation 556 may prevent the hub 250 from turning past a deadlocked position.

The cylinder lock retainer 550 may have indicia to indicate a preferred orientation. This can assist in ensuring the reversibility of the lock assembly. That is, from a first orientation (such as the handhold 102 pointing towards the left), the cylinder lock retainer 550 may be inserted in the "upwards" indicated direction. Then if the lock assembly is moved into a second orientation (such as by being rotated 180 degrees such that the handhold 102 is pointing towards the right), the cylinder lock retainer 550 can be removed and reoriented to again point in the "upwards" indicated direction. This allows for the lock assembly to be left or right handed without adjusting the orientation of the cylinder lock 500.

In some cases, a second cylinder lock 500 may be included. The tailpieces 506 of the two cylinder locks 500 may be connected via a coupler such that the rotation of the cylinder of one cylinder lock 500 causes rotation of the cylinder of the other cylinder lock. This allows the lock assembly to be moved between the unlocked, locked, and deadlocked modes from either side.

Alternatively, a cylinder lock 500 may be provided only on the outside facing portion of the lock assembly. It may be intended that the inside-facing portion of the lock assembly be operated only using the hand-operable member 300. The inside-facing portion may have a plug inserted in the cylinder lock aperture 108, such as a plug which avoids the lock from entering the deadlocked mode.

Use

In use, the lock assembly can be in five modes. A first unlocked mode, a second unlocked mode, a first locked mode, a second locked mode, and a deadlocked mode. The detent provided by the spring 280 and the five indents 258 on the hub 250 bias the hub 250 to enter positions corresponding to each of these five modes.

Figure 6:
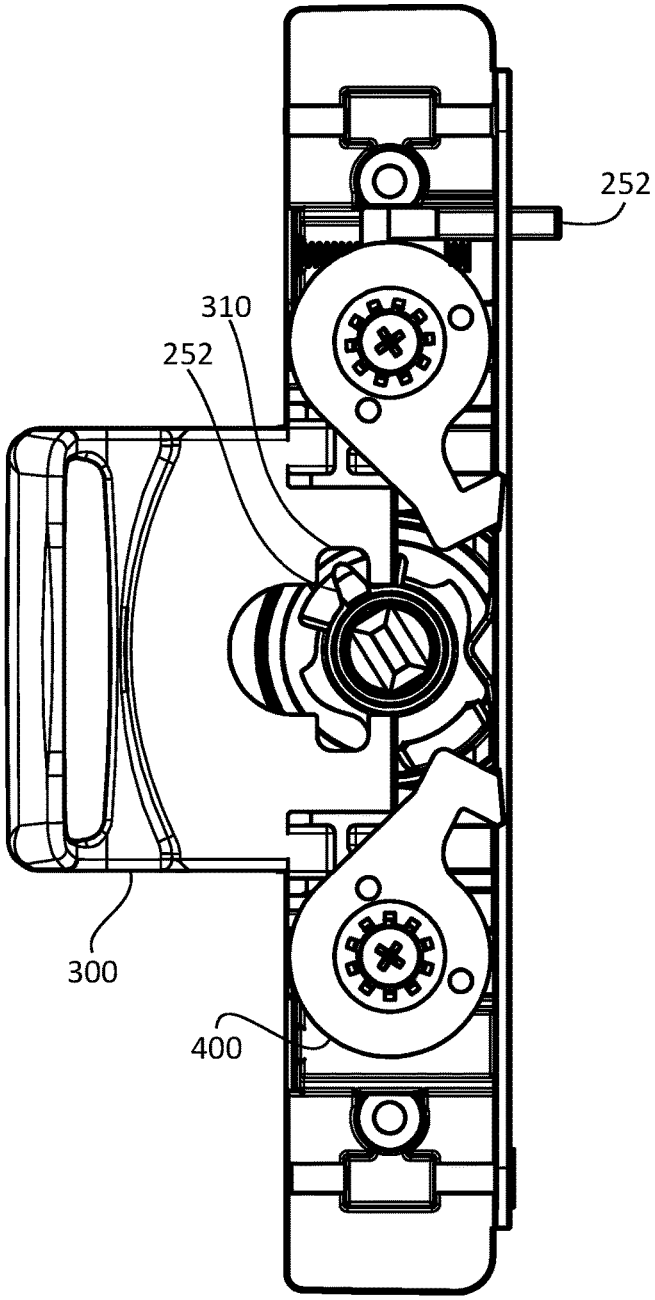
FIG. 6 shows the lock assembly of FIG. 1 in a first unlocked mode.

FIG. 6 shows the lock assembly in a first unlocked mode. In this mode, the hand-operable member 300 is in an extended position so that the fingerhold 302 is far from the hub 250. The cam 252 of the hub 250 sits within a cut-out 310 in the body plate 306 of the hand-operable member 300. This corresponds to the hub 250 being in the first unlocked position. Due to the extended position of the hand-operable member 300 and the direct connection to the beaks 400 via pin 404, the beaks are in the withdrawn position.

The anti-slam button 352 is extended. This means that the block 356 is aligned with a pin 404 of the beak 400. This would prevent the beak 400 from being rotated into an extended position. In addition, due to the coupling between the beak 400 and the hand-operable member, this prevents the hand-operable member from being pushed in.

Figure 7:
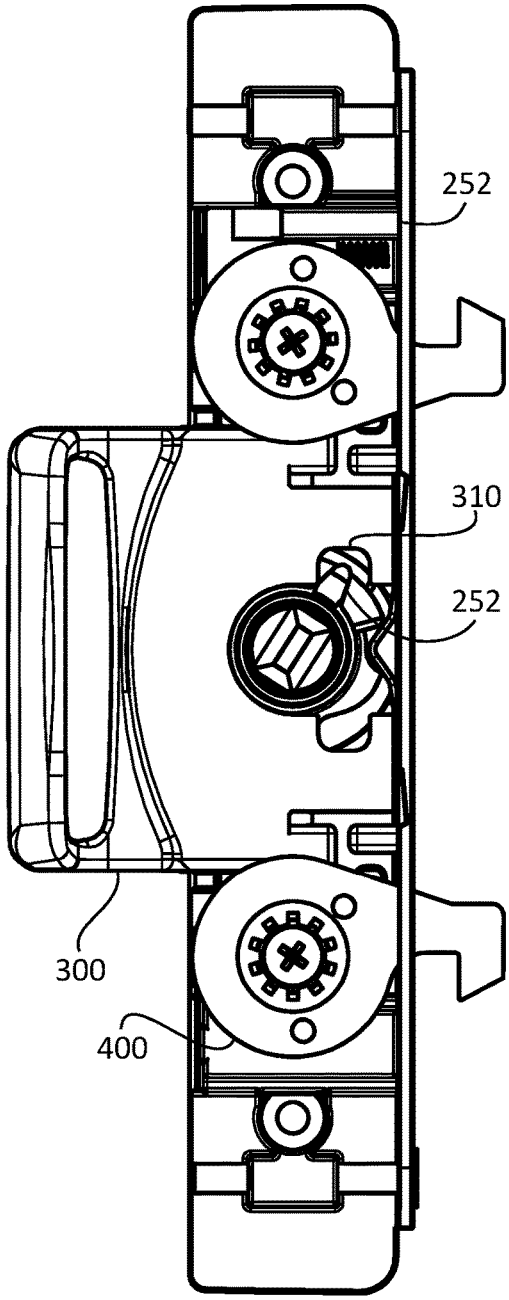
FIG. 7 shows the lock assembly of FIG. 1 in a first locked mode.

FIG. 7 shows the lock assembly in a first locked mode.

The anti-slam button 352 is withdrawn. This means that the recess 358 is aligned with a path of the pin 404 of the beak 400, and the block 356 is out of alignment with the pin 404. This allows the beak 400 to be rotated into an extended position. In addition, due to the coupling between the beak 400 and the hand-operable member, this allows the hand-operable member from being pushed in.

The lock assembly can then enter the first locked mode from the first unlocked mode from the user pushing in the hand-operable member 300 so that the hand-operable member 300 enters a withdrawn position so that the fingerhold 302 is close to the hub 250 (relative to the extended position). This causes the sides of the cut-out 310 in the body plate 306 to push against the cam 252 until the hub 250 rotates clockwise into the first locked position. Alternatively, a user may turn the cylinder 502 of the cylinder lock 500 clockwise by use of an appropriate key. The rotation of the cylinder 502 is translated to rotation of the tailpiece 506. The coupling between the tailpiece 506 and the channel 260 causes the hub 250 to rotate into the first locked position. This consequently also causes the hand-operable member to be brought into the withdrawn position, due to the cam 252 pulling against the side of the cut-out 310.

In either case, movement of the hand-operable member 300 into the withdrawn position causes the beaks 400 to pivot about posts 410. This occurs due to the pins 404 sitting in the pockets 314. The hand-operable member 300 being in the withdrawn position corresponds to the beaks 400 being in their engaged positions.

Conversely, the lock assembly can enter the first unlocked mode from the first locked mode from the user pulling out the hand-operable member 300 so that the hand-operable member 300 enters the extended position. This causes the sides of the cut-out 310 in the body plate 306 to pull against the cam 252 until the hub 250 rotates anti-clockwise into the first unlocked position. Alternatively, a user may turn the cylinder 502 of the cylinder lock 500 anti-clockwise by use of an appropriate key. The rotation of the cylinder 502 is translated to rotation of the tailpiece 506. The coupling between the tailpiece 506 and the channel 260 causes the hub 250 to rotate into the first unlocked position. This consequently also causes the hand-operable member to be brought into the extended position, due to the cam 252 pushing against the side of the cut-out 310.

Movement of the hand-operable member 300 into the extended position causes the beaks 400 to pivot about posts 410. This occurs due to the pins 404 sitting in the pockets 314. The hand-operable member 300 being in the extended position corresponds to the beaks 400 being in their withdrawn positions.

The lateral (and substantially horizontal) movement of the hand-operable member 300 therefore drives rotational movement of the beaks 400.

In this way, a user can use the hand-operable member 300 or the cylinder lock 500 to move the lock assembly between a first unlocked position (in which the hand-operable member 300 is in an extended position, the hub 250 is in a first unlocked position, and the beaks 400 are in a withdrawn position) and a first locked position (in which the hand-operable member 300 is in a withdrawn position, the hub 250 is in a first locked position, and the beaks 400 are in an extended position).

Figure 8:
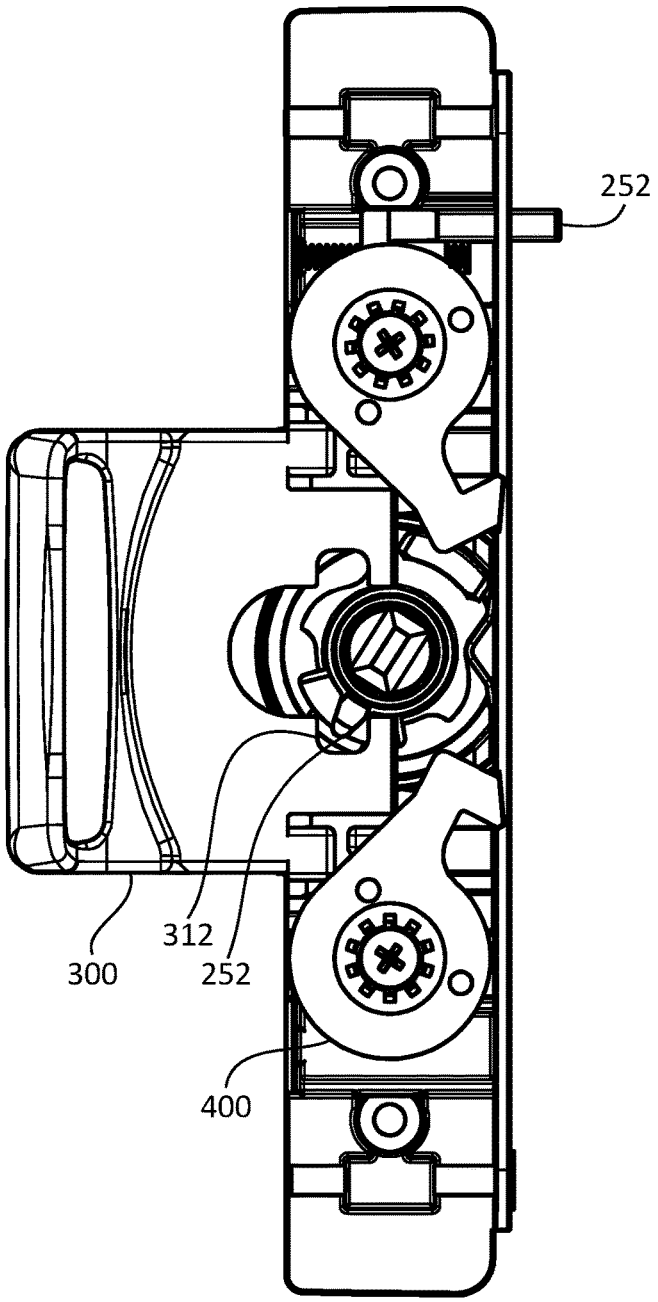
FIG. 8 shows the lock assembly of FIG. 1 in a second unlocked mode.

FIG. 8 shows the lock assembly in a second unlocked mode. The second unlocked mode is the same as the first unlocked mode, except that the cam 252 of the hub 250 sits in the cut-out 312 in the body plate 306 of the hand-operable member 300.

Figure 9:
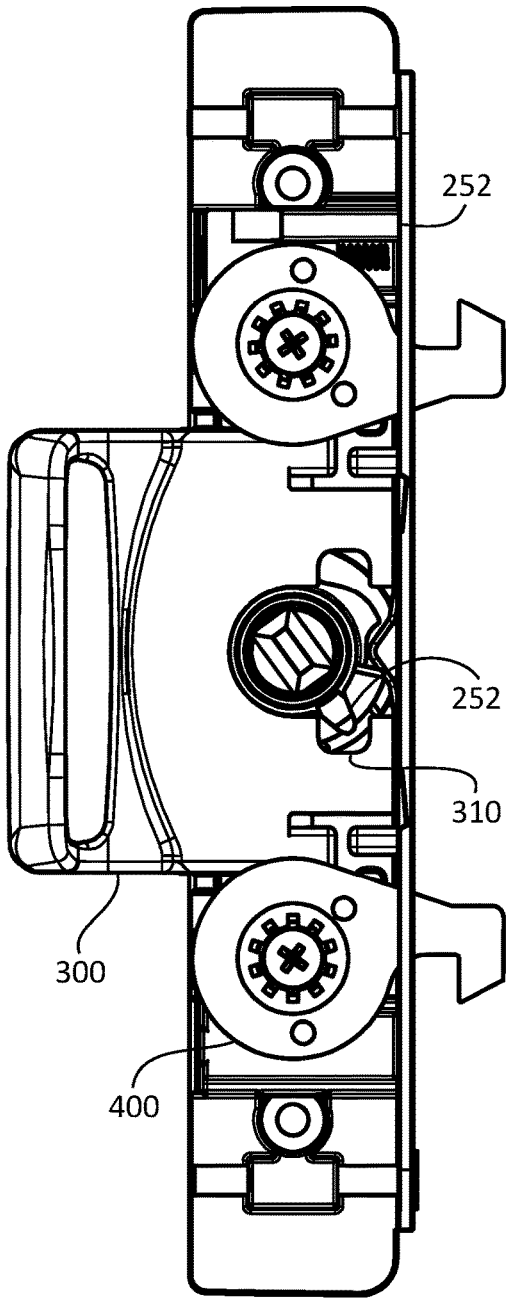
FIG. 9 shows the lock assembly of FIG. 1 in a second locked mode.

FIG. 9 shows the lock assembly in a second locked mode. The second locked mode is the same as the first locked mode, except that the cam 252 of the hub 250 sits in the cut-out 312 in the body plate 306 of the hand-operable member 300.

The lock assembly moves from the second unlocked mode to the second locked mode the user pushing in the hand-operable member 300 so that the hand-operable member 300 enters a withdrawn position (as with moving from the first unlocked mode to the first locked mode). Alternatively, a user may turn the cylinder 502 of the cylinder lock 500 anti-clockwise by use of an appropriate key. This is the opposite angular direction to moving from the first unlocked mode to the first locked mode.

Conversely, the lock assembly moves from the second locked mode to the second unlocked mode the user pulling out the hand-operable member 300 so that the hand-operable member 300 enters an extended position (as with moving from the first locked mode to the first unlocked mode). Alternatively, a user may turn the cylinder 502 of the cylinder lock 500 clockwise by use of an appropriate key. This is the opposite angular direction to moving from the first locked mode to the first unlocked mode.

Figure 10:
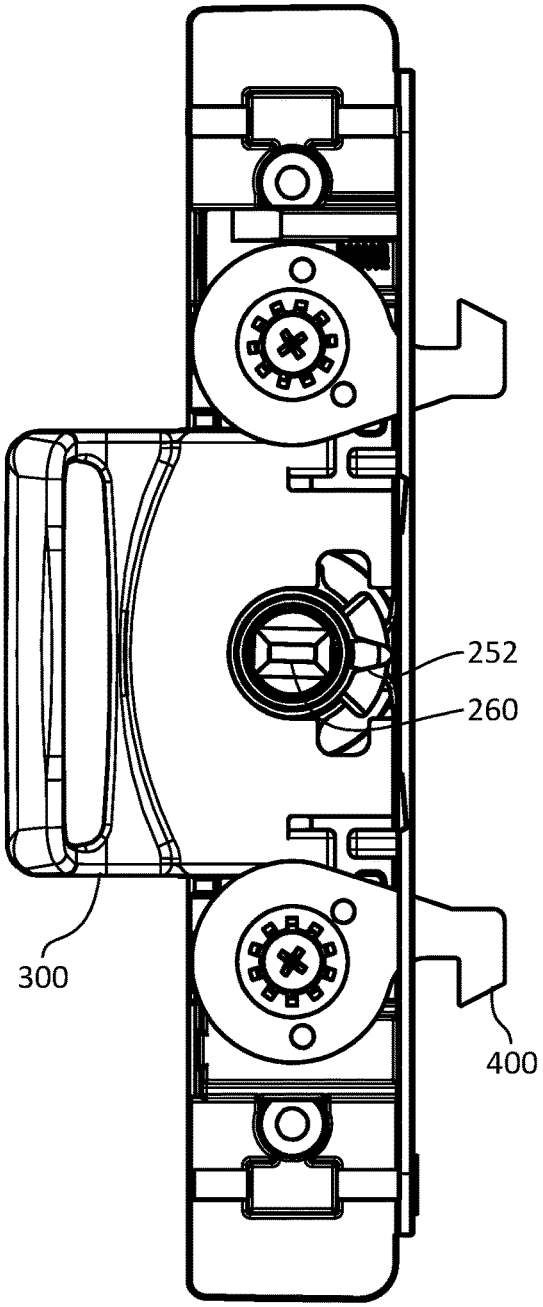
FIG. 10 shows the lock assembly of FIG. 1 in a deadlocked mode.
Figure 11:
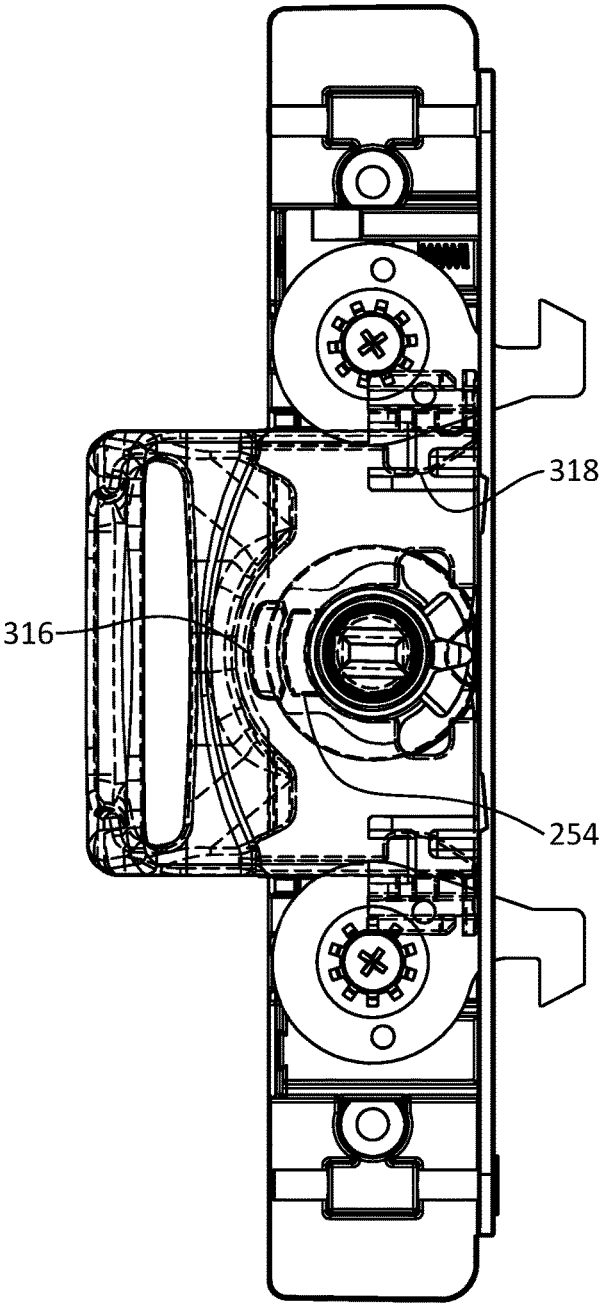
FIG. 11 shows a partially transparent view of the lock assembly of FIG. 10.
Figure 12:
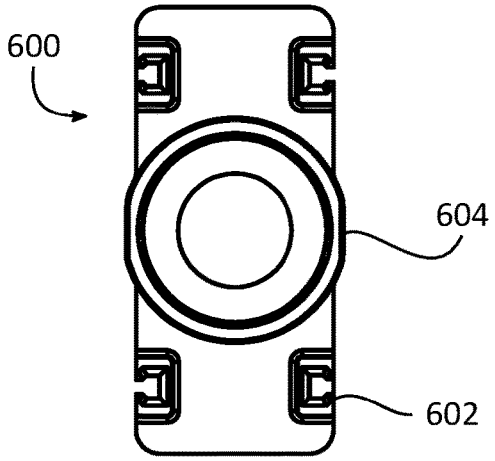
FIG. 12 shows a front view of a plug according to one example embodiment.
Figure 14:
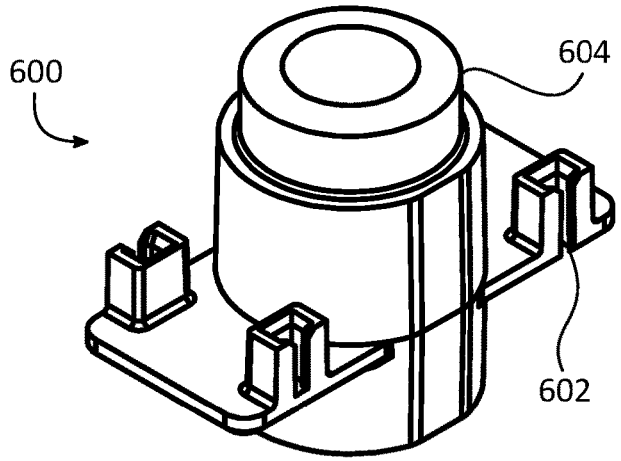
FIG. 14 shows a front isometric view of the plug of FIG. 12.
Figure 13:
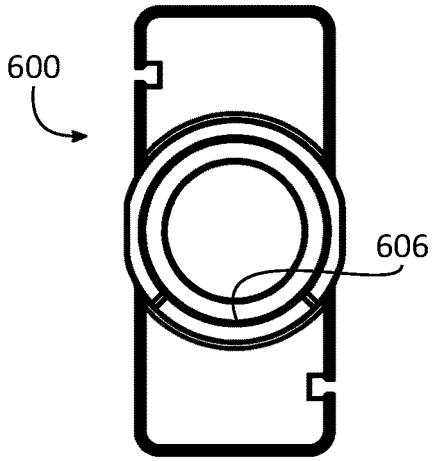
FIG. 13 shows a back view of the plug of FIG. 12.
Figure 15:
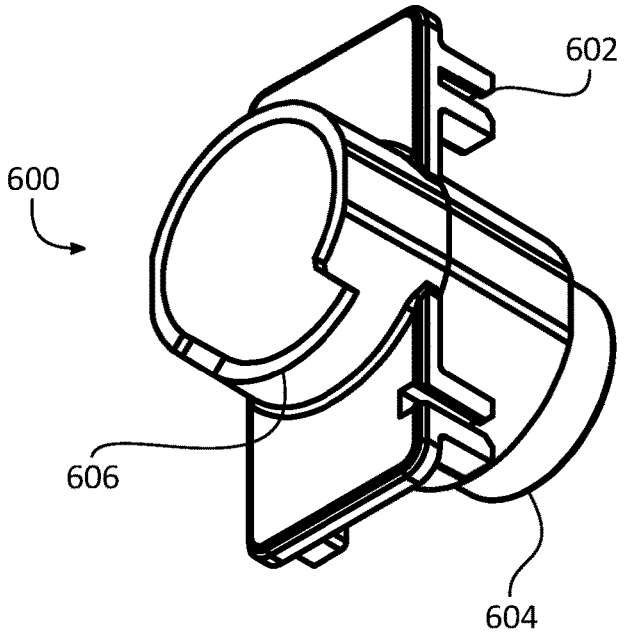
FIG. 15 shows a back isometric view of the plug of FIG. 12.

FIG. 10 shows the lock assembly in a deadlocked mode, and FIG. 11 shows a partially transparent view of the lock assembly in the deadlocked mode.

The beaks 400 remain in their extended position and the hand-operable member 300 remains in its withdrawn position.

The hub 250 is rotated so that the locking protrusion 254 is aligned with the block 316 on the back face of the hand-operable member 300. If the hand-operable member 300 is attempted to be pulled out, the block 316 abuts the locking protrusion 254. This prevents the hand-operable member 300 from being withdrawn. In this way, the lock assembly is in a deadlocked mode.

The lock assembly moves from the first locked position to the deadlocked position by the cylinder 502 of the cylinder lock 500 being rotated clockwise by use of an appropriate key. The rotation of the cylinder 502 is translated to rotation of the tailpiece 506. The coupling between the tailpiece 506 and the channel 260 causes the hub 250 to rotate into the deadlocked position. After moving from the first locked position to the deadlocked position, the formation 556 on the cylinder lock retainer 550 prevents further rotation of the hub 250 beyond the deadlocked position (and towards the second locked position). The hub 250 is only able to be turned back towards the first locked position.

The lock assembly moves from the second locked position to the deadlocked position by the cylinder 502 of the cylinder lock 500 being rotated anti-clockwise by use of an appropriate key. The rotation of the cylinder 502 is translated to rotation of the tailpiece 506. The coupling between the tailpiece 506 and the channel 260 causes the hub 250 to rotate into the deadlocked position. After moving from the second locked position to the deadlocked position, the formation 556 on the cylinder lock retainer 550 prevents further rotation of the hub 250 beyond the deadlocked position (and towards the first locked position). The hub 250 is only able to be turned back towards the second locked position.

When the lock assembly is in the deadlocked mode, the block 316 may be partly visible to a user. For example, the block 316 may be visible through a gap or window in the hand-operable member 300. The block 316 may therefore act as an indicator or the like to show whether the lock assembly is in a deadlocked mode. In other modes, the block 316 may be out of alignment with the gap or window, and so is not visible to indicate a deadlocked mode.

This operation shows the reversible nature of the lock assembly. That is, the lock assembly can be configured to rotate clockwise or anti-clockwise for locking without a relative small number of configuration changes.

Plug

As noted above, in some cases it may be intended that the lock assembly does not enter a deadlocked mode. For example, this may be because no cylinder lock 500 is provided on an inside of the lock assembly. If such a lock assembly could enter a deadlocked mode, this would mean that a user on the inside may be unable withdraw the beaks.

FIGS. 12 to 15 show a plug 600 which can be used to prevent a deadlocked mode.

The plug 600 can be installed in place of a cylinder lock retainer 550. The plug has clips 602 to engage with the retainer mounting 114 via a friction fit. The plug 600 may have a cover 604 which fits in the cylinder lock aperture 108. The cover 604 may be rubber, plastic, or another material which can slightly deform to snugly fit in the cylinder lock aperture 108.

The plug 600 has a formation 606 which limits the rotation of the hub 250. The formation 606 has a recess bounded by walls which defines a path through which the cam 252 of the hub 250 can move. At either end of the recess, the cam 252 would abut one of the walls. This prevents the cam 252 moving further, and so prevents further rotation of the hub 250.

The formation 606 is configured to prevent the hub 250 rotating into a deadlocked position. In this way, the formation 606 may be narrower than the formation 556 of the cylinder lock retainer 550, which allows for rotation into the deadlocked position.

By using a plug 600, the lock assembly can have its deadlocked mode disabled without the need for replacing the lock assembly and with minimal changes to the internal configuration of the lock assembly.

Installation

As noted above, the direction of rotation of the cylinder 502 of the cylinder lock 500 to move the lock assembly between an unlocked mode and a locked mode depends on whether the cam 252 is in the first unlocked position or the second unlocked position.

This may be beneficial when the cylinder lock retainer 550 has a formation 556 to limit rotation of the hub 250. Since the formation 556 defines a path of movement for the cam 252 of the hub 250, the movement of the cam 252 through the unlocked position, locked position, and deadlocked position should be aligned with the formation 556. Depending on the orientation of the cylinder lock retainer 550, this may require a clockwise or anti-clockwise movement of the cylinder 502 to move from unlocked to locked.

Similarly, if a plug 600 is used, the cam 252 of the hub 250 may need to be aligned with the formation 606 of the plug 600.

When installing the lock assembly, the hub 250 may be set into position before the cylinder lock 500 is installed. If the hub 250 is in the first unlocked position or first locked position when the cylinder lock 500 is installed, then the cylinder 502 will need to be rotated clockwise to move from the first unlocked position to the first locked position. If the hub 250 is in the second unlocked position or second locked position when the cylinder lock 500 is installed, then the cylinder 502 will need to be rotated anti-clockwise to move from the second unlocked position to the second locked position.

By adjusting which unlocked position and locked position is used, the rotation direction of the cylinder lock 500 can be switched. This occurs without the need to move or adjust any internals of the lock assembly other than the starting position of the cam 252.

In an alternative installation approach, the hub 250 may be put in the deadlocked position when the cylinder lock 500 is installed. This allows a user to select a preferred rotation direction on first use. If the user rotates the cylinder 502 to move the hub into the first locked position on the first use, then the cylinder 502 will need to be rotated clockwise to move from the first unlocked position to the first locked position. If the user rotates the cylinder 502 to move the hub into the second locked position on the first use, then the cylinder 502 will need to be rotated anti-clockwise to move from the second unlocked position to the second locked position. This allows a user to select the rotation direction of the cylinder lock 500 while adjusting relative little of the internal configuration of the lock assembly.

Interpretation

The term "comprises" and other grammatical forms is intended to have an inclusive meaning unless otherwise noted. That is, they should be taken to mean an inclusion of the listed components, and possibly of other non-specified components or elements.

The present invention has been illustrated by the description of some embodiments. While these embodiments have been described in detail, this should not be taken to restrict or limit the scope of the claims to those details. Additional advantages and modifications will readily appear to those skilled in the art. Therefore, the invention in its broader aspects is not limited to the specific details of the illustrative examples shown and described. Accordingly, modifications may be made to the details without departing from the spirit or scope of the general inventive concept.

What is claimed is:

1. A lock assembly comprising:

a hand-operable member configured to move laterally relative to a fore-end of the lock assembly;

a hub configured to communicate with the hand-operable member;

wherein lateral movement of the hand-operable member causes the lock assembly to move between a locked mode and an unlocked mode;

wherein the hub is selectively configured to rotate between one of: a first unlocked position, a first locked position, and a deadlocked position, a second unlocked position, and a second locked position;

wherein the hub moves from the first unlocked position via the first locked position to the deadlocked position by rotation in a first angular direction, and wherein the hub moves from the second unlocked position via the second locked position to the deadlocked position by rotation in a second angular direction opposite to the first angular direction.

2. The lock assembly of claim 1, wherein the lateral movement is substantially horizontal.

3. The lock assembly of claim 1, wherein the lateral movement of the hand-operable member causes rotational movement of a latch.

4. The lock assembly of claim 3, wherein the latch comprises one or more beaks.

5. The lock assembly of claim 4, wherein the latch comprises two counter-rotating beaks.

6. A lock assembly comprising:

a latch, the latch configured to move rotationally relative to the lock assembly; and a hand-operable member configured to move laterally relative to a fore-end of the lock assembly;

a hub configured to communicate with the hand-operable member;

wherein the hand-operable member is coupled to the latch such that lateral movement of the hand-operable member drives rotational movement of the latch;

wherein the hub is selectively configured to rotate between one of: a first unlocked position, a first locked position, and a deadlocked position, a second unlocked position, and a second locked position;

wherein the hub moves from the first unlocked position via the first locked position to the deadlocked position by rotation in a first angular direction, and wherein the hub moves from the second unlocked position via the second locked position to the deadlocked position by rotation in a second angular direction opposite to the first angular direction.

7. The lock assembly of claim 6, wherein a bias member is configured to bias the hub into the first unlocked position, the first locked position, the second unlocked position, the second locked position, and the deadlocked position.

8. The lock assembly of claim 7, wherein the bias member is configured to bias the hand-operable member into a locked position or an unlocked position.

9. The lock assembly of claim 6, wherein the hub comprises a locking protrusion configured to lock the hand-operable member in a withdrawn position when the hub is in a deadlocked position.

10. The lock assembly of claim 6, wherein the hub comprises a channel configured to receive a portion of a lock, such that rotation of the portion causes rotation of the hub.

11. The lock assembly of claim 6, further comprising a lock retainer for receiving a lock, wherein the lock retainer is orientatable to adjust the position of the lock relative to a fore-end of the lock assembly.

12. The lock assembly of claim 11, wherein the lock retainer is configured to limit the rotation of the hub beyond a deadlocked position.

13. The lock assembly of claim 6, further comprising a plug, wherein the plug is configured to prevent the hub from entering the deadlocked position.

14. The lock assembly of claim 6, wherein the latch comprises one or more beaks, and each beak comprises a plurality of laminated layers fixed together by a respective pin.

15. A method of at least partially installing a lock assembly, the method comprising:

setting a hub of the lock assembly to one of a first unlocked position, a first locked position, a second unlocked position, a second locked position, a deadlocked position; and installing a cylinder lock for engagement with the hub after setting the hub of the lock assembly to one of the first unlocked position, the first locked position, the second unlocked position, the second locked position, the deadlocked position;

wherein if the hub is set to the first unlocked position or the first locked position, the hub is configured to move from the first unlocked position via the first locked position to the deadlocked position by rotation of the hub in a first angular direction, and if the hub is set to the second unlocked position or the second locked position, the hub is configured to move from the second unlocked position via the second locked position to the deadlocked position by rotation of the hub in a second angular direction opposite to the first angular direction.

16. The method of claim 15, wherein installing the cylinder lock comprises:

inserting a cylinder lock retainer; and inserting the cylinder lock into the cylinder lock retainer;

wherein an orientation of the cylinder lock retainer defines the orientation of the cylinder lock relative to the lock assembly.

17. The method of claim 15, further comprising:

inserting a plug into the lock assembly, the plug being configured to prevent the hub from entering the deadlocked position.

18. The method of claim 15, wherein setting a hub of a lock assembly to one of the first unlocked position, the first locked position, the second unlocked position, the second locked position, the deadlocked position comprises: setting the hub of the lock assembly to the deadlocked position, the method further comprising:

rotating the cylinder lock towards one of a first locked position and a second locked position;

wherein if the cylinder lock is rotated towards the first locked position, the cylinder lock cannot be rotated into the second locked position, and if the cylinder lock is rotated towards the second locked position, the cylinder lock cannot be rotated into the first locked position.

* * * * *